US005860544A

United States Patent [19]

Brucker

[11] Patent Number: 5,860,544

[45] Date of Patent: Jan. 19, 1999

[54] TAMPER-EVIDENT PULL TAB INDUCTION LINER WITH IMPROVED MOISTURE MIGRATION RESISTANCE AND METHOD OF SEALING WITH SAME

[75] Inventor: Steven A. Brucker, Gibson City, Ill.

[73] Assignee: Selig Sealing Products, Inc., Forrest, Ill.

[21] Appl. No.: 831,417

[22] Filed: Apr. 1, 1997

[51] Int. Cl.[6] ..... B65D 43/02

[52] U.S. Cl. ..... 215/232; 215/258; 215/347; 215/349; 220/359; 229/123.1; 229/123.2

[58] Field of Search ..... 215/232, 251, 215/258, 341, 347, 348, 349; 220/359, 258, 276; 229/123.1, 123.2, 125.35

[56] References Cited

U.S. PATENT DOCUMENTS 4,588,099 5/1986 Diez ..... 215/232
4,596,338 6/1986 Yousif ..... 215/232
5,197,618 3/1993 Goth .

FOREIGN PATENT DOCUMENTS 1587725 4/1981 United Kingdom .

*Primary Examiner*—Stephen Cronin
*Attorney, Agent, or Firm*—Hill & Simpson

[57] ABSTRACT

A tamper-evident heat induction liner for sealing a container includes at least four stacked layers and exhibits improved resistance to moisture migration. A heat seal polymer layer is provided for induction bonding against a container opening. A moisture-impermeable foil layer is secured against the polymer layer opposite the container opening. Tear-resistant backing layer is provided, and is secured to a low cohesive strength layer which is disposed between the backing layer and the foil layer. The low cohesive layer splits when the backing layer is lifted, leaving the foil layer and polymer layer with a portion of the split low cohesive strength layer covering the container opening in a tamper-evident, rupturable manner.

15 Claims, 1 Drawing Sheet

TAMPER-EVIDENT PULL TAB INDUCTION LINER WITH IMPROVED MOISTURE MIGRATION RESISTANCE AND METHOD OF SEALING WITH SAME

BACKGROUND OF THE INVENTION

The present invention generally relates to tamper-evident induction foil liners for sealing containers. The present invention more specifically relates to an improved tamper-evident induction foil liner which provides an enhanced water vapor barrier.

Tamper-evident liners are common for sealing containers, for example, bottles containing drugs or food. Such liners are especially useful because they prevent or warn of tampering with a containers contents.

To facilitate user-friendly liner removal, liners are often provided with an integral pull-tab which may be gripped by a person's fingers. One such type of pull-tab is formed by a portion of the foil disk seal which extends over the outer diameter of the container. The tab can be pulled upward and across the container opening to peel the foil disk from the container lip. A pull-tab liner of that type is disclose in U.S. Pat. No. 5,197,618, to Goth, which is incorporated herein by reference. That patent discloses a pull-tab liner structure and suitable materials for a fusion peelable-bond induction foil liner which is removed cleanly and easily from a container lip.

Referring to the Figures, a prior art liner 10 of the type disclosed in U.S. Pat. No. 5,197,618 is illustrated in FIGS. 1, 1A and 4. The prior art liner 10 consists of four stacked layers A, B, C and D. A first layer A is a peelable polymer layer which may be fusion-bonded to a lip defining an opening of a container 14. A second layer is a low cohesive strength layer B, disposed against the polymer layer A. A third layer is a foil layer C disposed against layer B on a side opposite the low cohesive strength layer A. A fourth layer is a tear-resistant backing layer D disposed on top of the foil layer C.

In certain applications, it is desirable that a pull-tab container liner minimizes or prevents the migration of moisture into a container interior. For example, dampness or humidity can damage or negatively affect various goods. Also, moisture migration out of a container is undesirable, as it may result in the drawing out of a product over an extended period. Unfortunately, many known induction foil liners, including that disclosed in afore-mentioned U.S. Pat. No. 5,197,618, permit an undesirable amount of moisture migration.

Therefore, it is an object of the present invention to provide an improved tamper-evident foil induction liner which reduces or prevents water vapor migration.

SUMMARY OF THE INVENTION

The aforementioned object is achieved through a tamper-evident foil induction liner (hereinafter "liner") according to the present invention which provides an improved barrier against moisture migration. To this end, an embodiment of present invention provides an induction liner for use in sealing a container opening, wherein the liner at least four layers: a heat seal polymer layer; a foil layer; a low cohesive strength layer; and a tear resistant backing layer. These layers are stacked in the order recited, and are secured together in a composite sheet. The polymer layer is of a type for heat induction fusion bonding to a container opening. The foil layer is moisture-impermeable and bonded to the polymer layer opposite the container opening. The backing layer is made of a relatively high-strength material. The low cohesive strength layer is disposed between, and bonded to the foil layer and the backing layer.

When the backing layer is removed, the low cohesive strength layer splits under mechanical forces to separate the backing layer from the foil layer. Upon this splitting, a first portion of the low cohesive strength layer adheres to the backing layer. A second portion of the low-cohesive strength layer adheres to the foil layer and the polymer layer as a rupturable tamper-evident cover over the container opening which may be easily removed by a consumer to access the container's contents. A preferred embodiment, the liner is shaped to have a pull-tab portion which extends outwardly from the container.

The present invention also provides a method of sealing using the above-described liner.

An advantage of the present invention is to provide a liner which greatly improves the moisture-migration resistance from ambient humidity into a container.

Additionally, the present invention provides a sealable bond which is not "peelable" as required in U.S. Pat. No. 5,197,618. Rather, the present invention preferably requires destruction of its layers to access the container. This advantageously provides enhanced tamper-indicatability.

Additional features and a vantages of the present invention are described in, and will be apparent from, the detailed description of the preferred embodiments, the figures and the claims.

DETAILED DESCRIPTION OF THE PRESENTLY PREFERRED EMBODIMENTS

Figure 1:
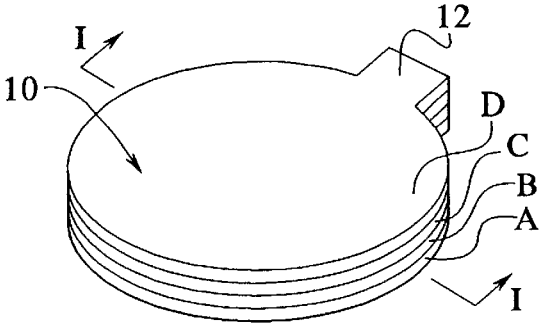
FIG.1 (PRIOR ART)
FIG. 1 is a perspective view of a prior art liner.
Figure 2:
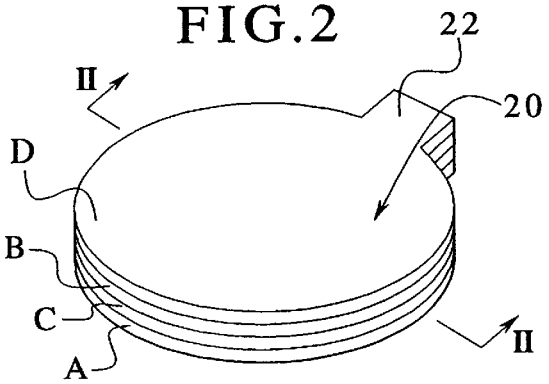
FIG. 2 is a perspective view of a liner according to an embodiment of the present invention.
Figure 1A:
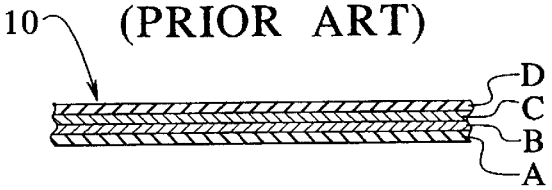
FIG.1A (PRIOR ART)
FIG. 1A is a fragmentary sectional view taken generally along line I—I of FIG. 1.
Figure 2A:
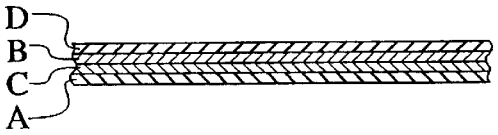
FIG. 2A is a fragmentary sectional view taken generally along line II—II of FIG. 2.
Figure 4:
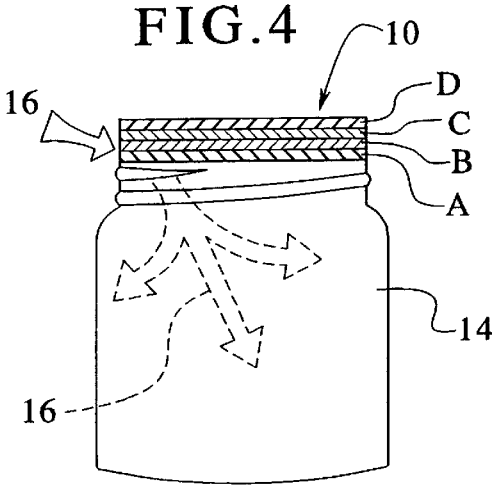
FIG. 4 is a side view of the prior art liner of FIG. 1, illustrating an undesirable migration of moisture through the sealed liner between the atmosphere and the interior of the container.

Referring to the Figures, wherein like numerals designate like parts, as explained above in the background, a known prior art liner 10 shown in FIGS. 1, 1A and 4 consists of four layers, A, B, C and D. The prior art liner has a pull-tab 12 extending outwardly.

Turning to FIGS. 2, 2A, 3 and 5, a liner 20 is illustrated according to an embodiment of the present invention including four stacked layers A, B, C and D, specifically: a polymer layer A; a foil layer C; a relatively low-cohesive strength layer B; and a tear-resistant backing layer D.

Figure 3:
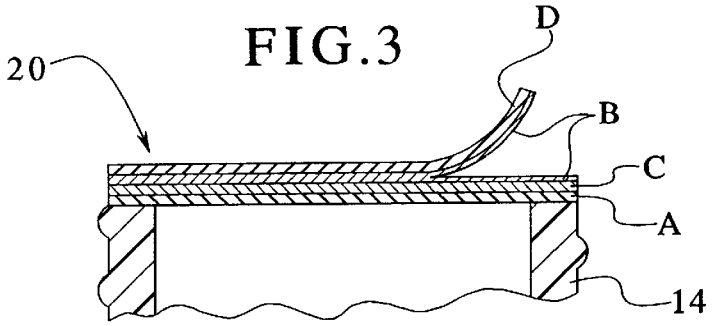
FIG. 3 is a sectional view of the liner of FIG. 2 sealing a container opening.
Figure 5:
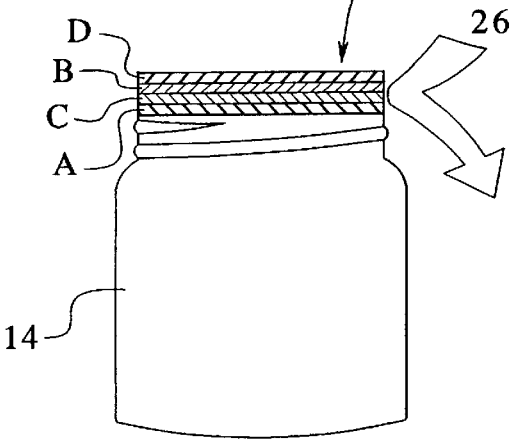
FIG. 5 is a side view of the improved liner of FIG. 2, illustrating how a liner according to an embodiment of the invention decreases or presents migration of moisture.

The polymer layer A is formed of a polymer to form a seal against a lip defining an opening of a container 14, as shown in FIGS. 3 and 5. The polymer layer A is a substance which facilitates a heat induction fusion bonding or welding against the container, forming a hermetical seal. Preferably, the heat seal polymer layer A is a substance commercially available from Pierce & Stevens, product number B4144X-8, commercially marketed as "PROXMELT" which has been found to work suitably with a wide variety of container materials. This substance is an EVA based resin composition Preferably, the heat seal polymer layer A is approximately 0.0015 in. thick.

Certain materials for the polymer layer A have been found as suitable in combination with particular container materials. With polyethylene containers, suitable heat seal polymer materials include: low density polyethylene; medium density polyethylene; ionomer; low density polyethylene with EVA 1%–9%; EVA based resin composition; and EAA. With polypropylene containers, suitable heat seal polymer materials include: copolymer polypropylene; EVA based resin composition; and EVA. With polystyrene containers, suitable heat seal polymers include: polystyrene and EVA based resin composition. With polyester containers, suitable heat seal polymers include: copolyester resins; and EVA based resin composition. With glass containers, suitable heat seal polymer materials include: ionomer; and EVA based resin composition.

The foil layer C is disposed against the polymer layer A. The foil layer C consists preferably of aluminum and is preferably between approximately 0.0003 and 0.0010 in. thick. Of course, other materials may be used which are moisture-impermeable and which tear to indicate tampering. Such foil materials are preferably metal, but alternatively may include certain polymers.

The low-cohesive strength layer B is preferably made of paper and can be a thickness of approximately 0.0020–0.0022 in. Other suitable relatively low-cohesive strength materials may include glassine and non-woven fabric.

The tear resistant backing layer D is secured in position against the low cohesive strength layer B. The tear-resistant backing layer D is preferably a polyethylene foam material. Other suitable backing materials include other foam polymers, polyethylene or other polymers in non-foam sheet form, paper, or other materials having high cohesive strength and tear resistance. Preferably, where the backing layer D is a polymer form, it has a thickness of around 0.006 in., and where the backing layer D is paper, it has a thickness of around 0.010 in.

The layers A, C, B and D are preferably bonded together by an adhesive, securing in the layers into a composite sheet prior to heat induction. This composite sheet may be easily handled and processed, cut in the desired liner shapes, and applied to a container for heat induction fusion bonding. As shown, the liner 20 is generally disk-shaped to fit over a circular container opening, but other shapes corresponding to various containers are possible.

The liner 20 is preferably formed with a pull-tab portion 22 extending beyond a periphery of the container. The pull-tab portion 22 is grippable to facilitate manual removal of the liner 20 after a cap (not shown) is removed from the container H. When the pull-tab 22 is lifted, the low-cohesive strength layer B splits and separates with a relatively low amount of force. A portion of the low cohesive strength layer B remains on the backing layer D, while a portion of the low cohesive strength layer B remains on the foil layer C. This leaves the foil layer C and polymer layer A with a portion of the low-cohesive strength layer B, which together are mechanically weak, sealed over the opening of the container 14. The foil layer and polymer layer A are easily punctured and removed from the container opening to provide access to the contents of the container 14. Any tampering with the integrity of the liner 20 is indicated a shearing of the foil layer C or a disruption of the polymer layer A, which are readily observable.

As illustrated in FIGS. 4 and 5, the moisture barrier characteristics provided by the liner 20 of the present invention (FIG. 5) are superior in comparison to the prior art liner (FIG. 4). FIG. 4 shows that ambient humidity, indicated by arrows 16 migrates through the prior art liner 10, invading the interior of the container 14. In contrast, FIG. 5 shows that the improved liner 20 according to an embodiment of the invention greatly reduces the rate of moisture migration from the ambient air into the container interior. Humidity, indicated by arrow 26 does not easily migrate through the liner 20, keeping the interior of a container 14 dryer than with the prior art liner 10.

As an example, confidential experimentation has been conducted to measure the improved performance of liners according to embodiments of the invention. In the experiment, containers were provided made of two common container materials, glass and high density polyethylene ("HDPE"). The glass containers had to have a 75 cc volume, and the HDPE containers had a 100 cc volume. All of the containers had a 38 MM, which is understood in the industry to have a specific opening size which is somewhat smaller, e.g., approximately 32 MM. A desiccant was placed in a bottle. A plurality of glass and HDPE containers were respectively sealed with liners of the type disclosed in U.S. Pat. No. 5,197,618 to Goth, and a plurality of glass and HDPE containers were sealed with a liner according to the invention described herein under identical conditions. The improved liners included an aluminum foil layer and a low-cohesive strength layer. Each of the containers was externally threaded to accommodate closing with a cap. Accordingly, the containers were capped using a torque meter to ensure uniform thread torque among the like containers. These dry-interior containers were then weighed. The containers were then all placed in a desiccator, where they were commonly subjected to a humid atmosphere over a period of two weeks (336 +/−1 hour). At the end of this period, the masses of the bottles were then measured again. The resulting moisture migration is revealed in Table 1.

TABLE 1

| | MIGRATION RATE (mgs/day) | |
|---|---|---|
| | PRIOR ART LINER | IMPROVED LINER |
| GLASS CONTAINER | 2.04 | 0.00 |
| HDPE CONTAINER | 3.35 | 0.27 |

These surprising results reflect the advantage that the inventive liner structure significantly substantially improves moisture migration resistance in comparison with the prior art liner. Based on this data, the inventive liner completely prevented any measurable moisture migration into the glass containers under the test conditions and the inventive liner used on HDPE containers reduced moisture migration by about 92% over the prior art.

Various changes and modifications to the presently preferred embodiments will be apparent to those skilled in the art. For example, the preferred layer thickness dimensions recited herein may be varied to any dimension with which the respective layers retain the characteristics required herein. Also, various materials may be used other than the layer materials recited herein, so long as such materials have suitable properties. Such changes and modifications may be made without departing from the spirit and scope of the present invention and without diminishing its attendant advantages. Accordingly, the foregoing description of the invention should be considered as illustrative, and not as limiting. Moreover, such changes and modifications are intended to be covered by the appended claims.

What is claimed is:

1. An induction liner for use in sealing a container opening, said liner comprising: a polymer layer for heat induction fusion bonding to a container opening; a moisture-impermeable foil layer bonded to said polymer layer opposite said container opening; a relatively high-strength backing layer; and a relatively low-cohesive strength layer between, and bonded to, said foil layer and said backing layer, said low-cohesive strength layer splitting upon removal of said backing layer by mechanical forces to separate said backing layer, with a first portion of the low-cohesive strength layer adhering thereto, from said foil layer, and with a second portion of the low-cohesive strength layer adhering to said foil layer and said polymer layer as a rupturable tamper-evident cover over the container opening.

2. A liner according to claim 1, wherein said polymer layer is a heat seal polymer membrane.

3. A liner according to claim 1, wherein said polymer layer is selected from the group consisting of: low density polyethylene; medium density polyethylene; ionomer; low density polyethylene with EVA 1%–9%; EVA based resin composition; EAA; copolymer polypropylene; EVA; polystyrene; and copolyester resins.

4. A liner according to claim 1, wherein said liner is substantially disk-shaped, said liner further comprising a pull-tab portion extending outwardly to facilitate removal of said backing layer by splitting said low-cohesive strength layer when said pull-tab is pulled.

5. A liner according to claim 1, wherein said foil is aluminum.

6. A tamper-evident liner for use in sealing a container, said liner comprising a composite of stacked layers including:

a polymer layer for heat-sealing to a container opening;

a moisture-impermeable foil layer secured to said polymer layer;

a low cohesive strength layer secured to said foil layer opposite said polymer layer; and a tear-resistant backing layer secured to said low cohesive strength layer opposite said foil layer;

wherein, said liner has a grippable pull-tab portion shaped to extend outwardly from said container opening, such that when the pull-tab is pulled upon, said low cohesive strength layer splits to permit removal of the backing layer, leaving the polymer layer, foil layer, and a portion of the low-cohesive strength layer being sealed over the container opening.

7. A liner according to claim 6, wherein the pull tab portion is comprised of portions of the polymer layer, the foil layer, the low cohesive strength layer, such that when the pull tab is pulled upon, the portions of polymer layer and foil layer shear adjacent the container opening and such that the pull tab remains intact at the backing layer.

8. A liner according to claim 6, wherein said low-cohesive strength layer made of paper.

9. A liner according to claim 7, wherein said polymer layer is selected from the group consisting of: low density polyethylene; medium density polyethylene; ionomer; low density polyethylene with EVA 1%–9%; EVA based resin composition; EAA; copolymer polypropylene; EVA; polystyrene; and copolyester resins.

10. A method of sealing a container opening with an induction liner, said method comprising the steps of:

providing a polymer layer which is heat sealable to a container opening;

securing a moisture-impermeable foil layer to said polymer layer;

securing a low cohesive strength layer to said foil layer opposite said polymer layer;

securing a tear-resistant backing layer to said low cohesive strength layer opposite said foil layer, said polymer layer, foil layer, low cohesive strength layer and backing layer forming a composite sheet; and positioning said composite sheet over a container opening; and heating the polymer layer so that it seals to a lip of said container.

11. A method according to claim 10, wherein said polymer layer is a heat seal polymer membrane.

12. A method according to claim 10, wherein said polymer layer is selected from the group consisting of: low density polyethylene; medium density polyethylene; ionomer; low density polyethylene with EVA 1%–9%; EVA based resin composition; EAA; copolymer polypropylene; EVA; polystyrene; and copolyester resins.

13. A method according to claim 10, further comprising:

providing said composite sheet in a disk-shape with a radially outwardly extending pull-tab portion.

14. A method according to claim 13, wherein said low-cohesive strength layer is made of paper.

15. A method according to claim 13, wherein said foil is aluminum.

* * * * *